US005326686A

United States Patent [19]

Katoh et al.

[11] Patent Number: 5,326,686

[45] Date of Patent: Jul. 5, 1994

[54] SILVER HALIDE PHOTOGRAPHIC MATERIAL

[75] Inventors: Kazunobu Katoh; Yoshiharu Yabuki, both of Kanagawa, Japan

[73] Assignee: Fuji Photo Film Co., Ltd., Kanagawa, Japan

[21] Appl. No.: 84,999

[22] Filed: Jul. 2, 1993

[30] Foreign Application Priority Data

Jul. 3, 1992 [JP] Japan ..... 4-177109

[51] Int. Cl.[5] ..... G03C 1/184

[52] U.S. Cl. ..... 430/517; 430/522; 430/523; 430/538; 430/539

[58] Field of Search ..... 430/510, 517, 538, 522, 430/523, 539

[56] References Cited

U.S. PATENT DOCUMENTS

| | | | |
|---|---|---|---|
| 4,629,667 | 12/1986 | Kistner et al. | 430/510 |
| 4,935,298 | 6/1990 | Dethlefs et al. | 430/538 |
| 4,940,654 | 7/1990 | Diehl et al. | 430/517 |
| 4,948,718 | 8/1990 | Factor et al. | 430/517 |
| 4,950,586 | 8/1990 | Diehl et al. | 430/517 |
| 5,075,205 | 12/1991 | Inagaki et al. | 430/517 |
| 5,098,820 | 3/1992 | McManus et al. | 430/517 |
| 5,232,825 | 8/1993 | Hattori et al. | 430/517 |
| 5,238,798 | 8/1993 | Usami | 430/517 |

*Primary Examiner*—Jack P. Brammer
*Attorney, Agent, or Firm*—Sughrue, Mion, Zinn, Macpeak & Seas

[57] ABSTRACT

A silver halide photographic material is described having a hydrophobic polymer layer which is not substantially swollen with processing solutions on one surface of a support and having at least one light-sensitive silver halide emulsion layer on the other surface of the support, and the material has a hydrophilic colloid layer containing a dispersion of fine solid grains of a dye having an absorption peak wavelength of from 600 nm to 1200 nm between the support and the emulsion layer. The material is exposed with a near infrared ray. The drying property of the processed material is improved, and the material is hardly curled during storage under varying conditions.

16 Claims, No Drawings

SILVER HALIDE PHOTOGRAPHIC MATERIAL

FIELD OF THE INVENTION

The present invention relates to a silver halide photographic material. In particular, the present invention relates to a silver halide photographic material having an improved drying property after development.

BACKGROUND OF THE INVENTION

Recently, in processing a silver halide photographic material, shortening of the development time has been needed.

In order to satisfy for shortening the development time, a means of improving the drying property of a silver halide photographic material with shortened drying time is effective.

As a means of improving the drying property, a method of reducing the amount of the binder in a silver halide photographic material is known, but the method involves various problems of lowering the mechanical strength of the material, blackening the scratches formed in the material, and generating roller marks in the material.

Blackening the scratches formed in the material results from a phenomenon such that the scratches as formed on the surface of the material in handling it before development are blackened to black scratches after development. Roller marks are black spots caused by fine bumps on the surfaces of the rollers of an automatic developing machine while a silver halide photographic material is processed with the machine under pressure of the rollers.

The black scratches and roller marks both noticeably lower the commercial value of a silver halide photographic material.

As another means of improving the drying property of a silver halide photographic material, a method of increasing the amount of the hardening agent to be added to the material is also effective.

In accordance with this method, swelling of the material during development is reduced so that the drying property of the material is improved.

However, this method involves various problems of lowering the sensitivity of the material due to retardation of development, lowering the covering power of the material, and increasing the residual silver and residual color in the processed material due to retardation of fixation. Therefore, sufficient improvement of the drying property could not be attained by this method.

For a silver halide photographic material having a silver halide emulsion layer on one surface of a support (hereinafter referred to as a "one-surface-coated photographic material"), removal of the non-light-sensitive hydrophilic colloid layer from the back surface of the material or replacement of the binder in the non-light-sensitive layer on the back surface of the same by a hydrophobic binder is effective for improving the drying property of the material.

However, the non-light-sensitive layer on the back surface generally contains an anti-halation dye, which is decolored or dissolved out into a processing solution by development so that the dye does not remain in the processed material. If a hydrophobic binder is in the layer, such decoloration or dissolution of the dye is impossible.

In particular, recently in the field of photomechanical printing materials and photographic materials for medical use, image processing appliances operating on laser rays have been developed, and materials are needed to satisfy both rapid processability and high image quality.

Provision of an anti-halation dye layer between the support and the silver halide emulsion layer in a silver halide photographic material has heretofore been known, and dyes which have effective light absorbability of laser rays, which may be fixed in an anti-halation layer and which may be decolored by development have been desired.

Provision of a hydrophobic binder layer on the back surface of a silver halide photographic material defectively enlarges the curling property of the material, and provision of an anti-halation layer to the same further enlarges it. Therefore, development of an effective halation-preventing technique without enlarging the curling property has been desired.

SUMMARY OF THE INVENTION

One object of the present invention is to provide a silver halide photographic material which has a good drying property after development and which may be exposed with near infrared rays.

A second object of the present invention is to provide a silver halide photographic material having a reduced curling property.

These and other objects have been attained by a silver halide photographic element containing a support having a front surface and a back surface, having a hydrophobic polymer layer which is not substantially swollen with processing solutions on the back surface and having on the front surface a hydrophilic colloid layer which contains a dispersion of fine solid grains of a dye having an absorption peak wavelength of from 600 nm to 1200 nm and which has thereon at least one light-sensitive silver halide emulsion layer.

DETAILED DESCRIPTION OF THE INVENTION

The hydrophobic polymer layer (hereinafter referred to as the "polymer layer") of the material of the present invention will be described below.

The polymer layer is not substantially swollen with processing solutions. The wording "not substantially swollen with processing solutions" as referred to herein means that the thickness of the polymer layer after rinsing in development of the material is not more than 1.05 times as large as the thickness of it after drying.

The binder in the polymer layer is not specifically limited, provided that the layer is "not substantially swollen with processing solutions".

Specific examples of the binder in the polymer layer are water-insoluble polymers, for example, polyethylene, polypropylene, polystyrene, polyvinyl chloride, polyvinylidene chloride, polyacrylonitrile, polyvinyl acetate, urethane resins, urea resins, melamine resins, phenolic resins, epoxy resins, fluorine resins (e.g., tetrafluoroethylene, polyvinylidene fluoride), rubbers (e.g., butadiene rubber, chloroprene rubber, natural rubber), acrylate or methacrylate polymers (e.g., polymethyl methacrylate, polyethyl acrylate), polyester resins (e.g., polyethylene phthalate), polyamide resins (e.g., nylon 6, nylon 66), cellulose resins (e.g., cellulose triacetate), and silicone resins, as well as derivatives of them.

The binder of the polymer layer may be either a homopolymer comprising one kind of monomer or a copolymer comprising two or more kinds of monomers.

The polymer layer may be composed of either one king of such a polymer singly or two or more kinds of such polymers in combination.

If desired, the polymer layer may optionally contain various photographic additives, for example, a mat agent, surfactant, dye, lubricant, crosslinking agent, viscosity increasing agent, UV absorbent, inorganic fine grains such as colloidal silica, etc.

For the additives, one can refer to the description of Research Disclosure, Vol. 176, Item 17643 (December, 1978 ).

The photographic material of the present invention may have one or more polymer layers, and the thickness of the polymer layer is not specifically defined.

However, if the thickness of the polymer layer is too small, the waterproofness of the layer would be insufficient so that the backing layer would be unfavorably swollen with processing solutions. On the contrary, if it is too large, the steam permeability of the polymer layer would be insufficient so that the hydrophilic colloid layer of the backing layer could not sufficiently absorb or release moisture, thereby causing curling of the photographic material. The thickness of the polymer layer depends upon also the physical properties of the binder. Therefore, the thickness of the polymer layer must be determined in consideration of both of them. The preferred thickness of the polymer layer is, depending upon the kind of the binder in the layer, within the range of from about 0.05 to about 10 μm, more preferably from about 0.1 to about 5 μm.

Where the photographic material of the present invention has two or more polymer layers, the total thickness of all the polymer layers is the thickness to be considered.

The photographic material of the present invention preferably has a non-light-sensitive hydrophilic polymer layer (hereinafter referred to as a "backing layer") between the hydrophobic polymer layer and the support.

The hydrophilic colloid to be in the backing layer is desirably similar to the binder in the photographic layers including the silver halide emulsion layers, relative to the moisture absorbing percentage and the moisture absorbing rate. Gelatin is most preferred as the hydrophilic colloid of the binder in the backing layer.

Any ordinary gelatin which is generally employed in this technical field can be in the layer, including, for example, so-called lime-processed gelatin, acid-processed gelatin, enzyme-processed gelatin, gelatin derivatives and modified gelatins.

Of them, lime-processed gelatin and acid-processed gelatin are most preferred.

Proteins such as colloidal albumin and casein; saccharide derivatives such as agar, sodium alginate and starch derivatives; cellulose compounds such as carboxymethyl cellulose and hydroxymethyl cellulose; and synthetic hydrophilic compounds such as polyvinyl alcohol, poly-N-vinylpyrrolidone and polyacrylamide are examples of hydrophilic colloids other than gelatin which can be used as the binder in the hydrophilic colloid layer.

Synthetic hydrophilic compounds to be used for this purpose may contain any other copolymerizing comonomers. However, if the content of hydrophobic copolymerizing components in them is too large, the moisture absorbability and the moisture-absorbing rate of the backing layer containing them would be unfavorably small from the viewpoint of preventing curling of the photographic material.

The hydrophilic colloids may be in the backing layer singly or in combination of two or more.

The backing layer of the photographic material of the present invention may contain, in addition to the binder, any other photographic additives, for example, a mat agent, surfactant, dye, crosslinking agent, viscosity increasing agent, antiseptic, UV absorbent, inorganic fine grains such as colloidal silica, etc.

For the additives, one can refer to the disclosure of Research Disclosure, Vol. 176, No. 17643 (December, 1978).

The backing layer may further contain a polymer latex.

As the polymer latex, an aqueous dispersion of water-insoluble polymer grains having a mean grain size of from 20 mμ to 200 mμ is preferred. The amount of the polymer latex in the layer is preferably from 0.01 to 1.0, especially preferably from 0.1 to 0.8, by weight, to 1.0 of the binder.

As preferred examples of the polymer latex employable in the present invention, polymers composed of monomer units of alkyl, hydroxyalkyl or glycidyl acrylates, or alkyl, hydroxyalkyl or glycidyl methacrylates, and having a mean molecular weight of 100,000 or more, especially preferably from 300,000 to 500,000, can be used.

The photographic material of the present invention may have one or more backing layers. The thickness of the backing layer is not specifically defined. It is preferably approximately from 0.2 μm to 20 μm, especially preferably approximately from 0.5 μm to 10 μm, in view of prevention of curling of the photographic material.

Where the material has two or more backing layers, the total thickness of all the backing layers is the thickness to be considered.

The backing layer of the photographic material of the present invention is not substantially swollen with processing solutions.

The wording "not substantially swollen with processing solutions" as referred to herein means that the thickness of the backing layer just after rinsing in development is 1.05 times or less as large as the thickness of the same layer after drying.

The backing layer of itself is naturally swollen with processing solution, since it contains a hydrophilic colloid such as gelatin as the binder.

In the constitution of the photographic material of the present invention, however, the backing layer is not substantially swollen with processing solutions due to the polymer layer being coated thereover.

The method of forming the backing layer in preparing the photographic material of the present invention is not specifically defined. For instance, any known method of coating a hydrophilic colloid layer on a support to prepare an ordinary silver halide photographic material may be employed. For example, a dip-coating method, an air knife-coating method, a curtain-coating method, a roller-coating method, a wire bar-coating method, a gravure-coating method, as well as an extrusion-coating method of using a hopper as described in U.S. Pat. No. 2,681,294, and a multi-layer co-extrusion coating method as described in U.S. Pat. Nos. 2,761,418, 3,508,947 and 2,761,791 can be used.

The method of coating the polymer layer in preparing the photographic material of the present invention is also not specifically defined.

For instance, after the backing layer has been coated and dried on a support, the polymer layer may be coated and dried on the backing layer; or alternatively, both the backing layer and the polymer layer may be coated simultaneously on a support and then dried thereon.

For coating the polymer layer, a solution of a binder polymer as dissolved in a solvent may be coated by a solvent system coating, or alternatively, an aqueous dispersion of a binder polymer may also be coated by an aqueous system coating.

The dispersion of fine solid grains of a dye for use in the present invention will be explained below.

The dye for use in the present invention as a dispersion of fine solid grains may be any dye having an absorption in the near infrared range but is preferably a dye having an absorption peak wavelength falling within the range of from 600 nm to 1200 nm, more preferably from 630 nm to 1000 nm.

As the preferred compounds, the following formulae (I) to (IX) can be used:

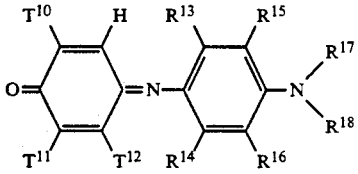

(I)

wherein $T^{10}$, $T^{11}$ and $T^{12}$ each independently represent a hydrogen atom, a halogen atom, a cyano group, a carboxyl group, an alkyl group, an aryl group, an alkoxy group, an aryloxy group, an alkylthio group, an arylthio group, an alkylsulfonyl group, an arylsulfonyl group, a sulfamoyl group, a carbamoyl group, an amino group, a sulfonamido group, a carbonamido group, an ureido group, a sulfamido group, a hydroxyl group, a vinyl group or an acyl group;

$R^{13}$ and $R^{14}$ each independently represent a hydrogen atom, a halogen atom, an alkoxy group, an alkyl group, an alkenyl group, an aryloxy group or an aryl group;

$R^{15}$ and $R^{16}$ each independently represent a hydrogen atom;

$R^{17}$ and $R^{18}$ each independently represent an alkyl group, an aryl group, a vinyl group, an acyl group, or an alkyl- or aryl-sulfonyl group;

provided that any of $T^{11}$ and $T^{12}$, $R^{13}$ and $R^{15}$, $R^{14}$ and $R^{16}$, $R^{17}$ and $R^{18}$, $R^{15}$ and $R^{17}$, and $R^{16}$ and $R^{18}$ can be bonded to each other to form a ring;

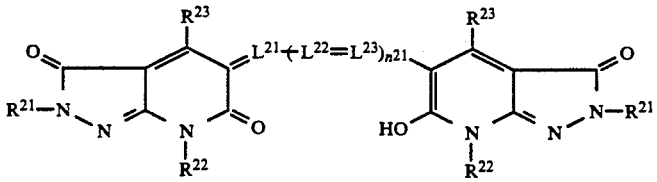

(II)

wherein $R^{21}$ represents a hydrogen atom, an alkyl group, an aryl group or a heterocyclic group;

$R^{22}$ represents a hydrogen atom, an alkyl group, an aryl group, a heterocyclic group, $COR^{24}$ or $SO_2R^{24}$;

$R^{23}$ represents a hydrogen atom, a cyano group, a hydroxyl group, a carboxylic acid group, an alkyl group, an aryl group, $COOR^{24}$, $OR^{24}$, $NR^{25}R^{26}$, $CONR^{25}R^{26}$, $NR^{25}COR^{24}$, $NR^{25}SO_2R^{24}$ or $NR^{25}CONR^{25}R^{26}$;

$R^{24}$ represents an alkyl group or an aryl group;

$R^{25}$ and $R^{26}$ each independently represent a hydrogen atom, an alkyl group or an aryl group;

$L^{21}$, $L^{22}$ and $L^{23}$ each independently represent a methine group; and $n^{21}$ represents 1 or 2;

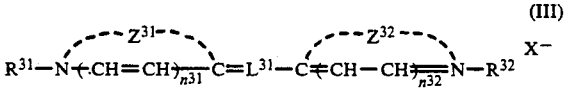

(III)

wherein $R^{31}$ and $R^{32}$ each independently represent an alkyl group, an alkenyl group or an aryl group;

$Z^{31}$ and $Z^{32}$ each independently represent a non-metallic atomic group necessary for forming a 5-membered or 6-membered nitrogen-containing hetero ring;

$L^{31}$ represents a linking group constituted from 5 or 7 methine groups bonded to each other by conjugated double bonds;

$X^-$ represents an anion; and $n^{31}$ and $n^{32}$ each independently represent 0 or 1;

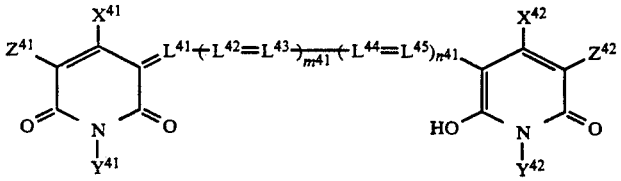

(IV)

wherein $X^{41}$ and $X^{42}$ each independently represent a hydrogen atom, a hydroxyl group, a carboxyl group, $-COOR^{41}$, $-COR^{41}$, $-CONH_2$, $-CONR^{41}R^{42}$, an alkyl group, an aryl group or a heterocyclic group;

$Y^{41}$ and $Y^{42}$ each independently represent a hydrogen atom, an alkyl group, an aryl group or a heterocyclic group;

$Z^{41}$ and $Z^{42}$ each independently represent a hydrogen atom, —CN, a carboxyl group, —$COOR^{43}$, —$COR^{43}$, —$CONH_2$, —$CONR^{43}R^{44}$, —$NHCOR^{43}$, —$NHSO_2R^{43}$, —$SO_2R^{43}$, an alkyl group, an aryl group or a heterocyclic group;

$R^{41}$ and $R^{43}$ each independently represent an alkyl group or an aryl group;

$R^{42}$ and $R^{44}$ each independently represent a hydrogen atom, an alkyl group or an aryl group;

$L^{41}$, $L^{42}$, $L^{43}$, $L^{44}$ and $L^{45}$ each independently represent a methine group; and $m^{41}$ and $n^{41}$ represent integers that add up to 2;

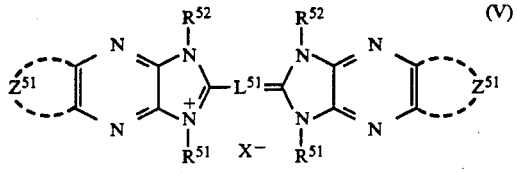

(V)

wherein $R^{51}$ and $R^{52}$ each independently represent an alkyl group, an alkenyl group or an aryl group;

$L^{51}$ represents a linking group constituted from 7 methine groups bonded to each other by conjugated double bonds;

$Z^{51}$ represents an atomic group for completing an aromatic ring in formula (V); and $X^-$ represents an anion;

$L^{71}$ represents a nitrogen atom or a group formed by 5 or 7 substituted or unsubstituted methine groups bonded to each other by conjugated double bonds;

E represents O, S or N—$R^{79}$;

$R^{70}$ and $R^{79}$ each independently represent a hydrogen atom, an alkyl group, an alkenyl group, an alkynyl group, an aryl group, a heterocyclic group, an amino group, a hydrazino group or a diazenyl group (—N=N—H);

$R^{71}$ represents a hydrogen atom, an alkyl group, an aryl group, an alkenyl group, an alkynyl group, or a heterocyclic group;

$R^{72}$ represents a hydrogen atom, a halogen atom, a cyano group, a nitro group, a hydroxyl group, a carboxyl group, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an alkylsulfonyl group, an arylsulfonyl group or an alkynyl group;

$R^{70}$ and $R^{79}$ can be bonded to each other to form a ring;

$R^{73}$ and $R^{74}$ each independently represent a hydrogen atom, a halogen atom, an alkoxy group, an alkyl group, an alkenyl group, an aryloxy group or an aryl group;

$R^{75}$ and $R^{76}$ each independently represent a hydrogen atom;

$R^{77}$ and $R^{78}$ each independently represent an alkyl group, an aryl group, a vinyl group, an acyl group or an alkyl- or aryl-sulfonyl group; provided that any of $R^{73}$ and $R^{75}$, $R^{74}$ and $R^{76}$, R77 and $R^{78}$, $R^{75}$ and R77, and $R^{76}$ and $R^{78}$ can be bonded to each other to form a ring;

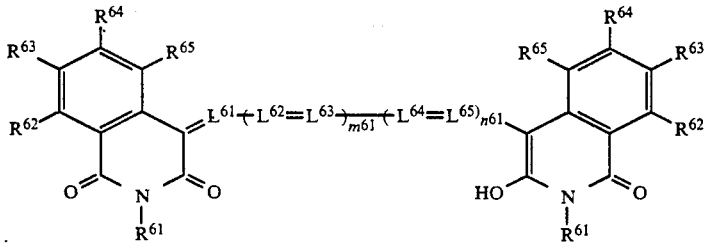

(VI)

wherein $R^{61}$ represents a hydrogen atom, an alkyl group or an aryl group;

$R^{62}$, $R^{63}$, $R^{64}$ and $R^{65}$ each independently represent a hydrogen atom, an alkyl group, a halogen atom, an alkoxy group, an alkoxycarbonyl group, a carboxyl group, a hydroxyl group or an amino group;

$L^{61}$, $L^{62}$, $L^{63}$, $L^{64}$ and $L^{65}$ each independently represent a methine group; and $m^{61}$ and $n^{61}$ represent integers that add up to 2;

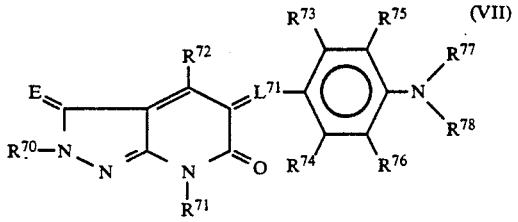

(VII)

wherein

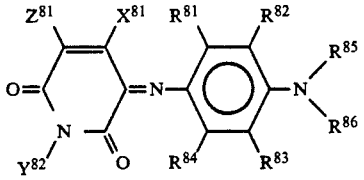

(VIII)

wherein $X^{81}$ represents a hydrogen atom, a hydroxyl group, $COOR^{87}$, $CONR^{87}R^{88}$, an alkyl group or an aryl group; $Y^{82}$ represents a hydrogen atom, an alkyl group, an aryl group, a heterocyclic group or $NR^{87}R^{88}$; $Z^{81}$ represents a hydrogen atom, an alkyl group, an aryl group, a cyano group, $COOR^{89}$, $CONR^{87}R^{88}$, COR89, $SO_2R^{89}$, $NR^{88}COR^{89}$, a nitro group or a pyridinium group; $R^{81}$, $R^{82}$, $R^{83}$ and $R^{84}$ each independently represent a hydrogen atom, an alkyl group, $OR^{89}$, $NR^{89}COR^{87}$, $COOR^{89}$, $CONR^{87}R^{88}$ or a halogen atom;

$R^{85}$ and $R^{86}$ each independently represent a hydrogen atom, an alkyl group, an aryl group or a heterocyclic group; $R^{87}$, $R^{88}$ and $R^{89}$ each independently represent a hydrogen atom, an alkyl group, an aryl group or a heterocyclic group; provided that any of $R^{81}$ and $R^{82}$, $R^{85}$ and $R^{86}$, $R^{82}$ and $R^{85}$, $R^{83}$ and $R^{86}$, and $R^{87}$ and $R^{88}$ can be bonded to each other to form a 5-membered or 6-membered ring.

$L^{91}$, $L^{92}$, $L^{93}$, $L^{94}$, $L^{95}$ and $L^{96}$ each independently represent a methine group;

$n^{94}$, $m^{91}$ and $n^{91}$ each independently represent 0 or 1, provided that $m^{91}$, $n^{91}$ and $n^{94}$ add up to an integer of 2 or more;

provided that the compound of formula (IX) has at least one carboxyl group, a sulfonic acid arylamido group or a phenolic hydroxyl group therein.

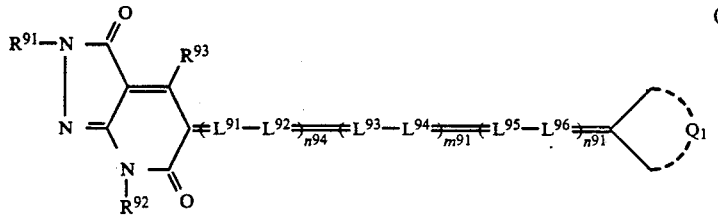

(IX)

wherein $R^{91}$, $R^{92}$ and $R^{93}$ each independently represent a hydrogen atom, an alkyl group or an aryl group;

$Q^1$ represents an atomic group necessary for forming a nitrogen containing 4 to 6 membered hereto ring;

Specific examples of preferred dye compounds capable of forming a dispersion of fine solid grains for use in the present invention are set forth below, which, however, should not be construed as limiting the present invention.

1.

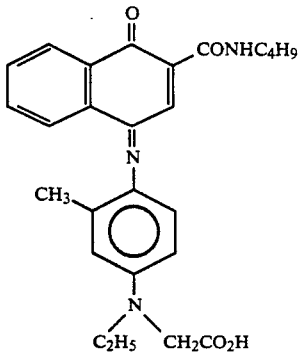

2.

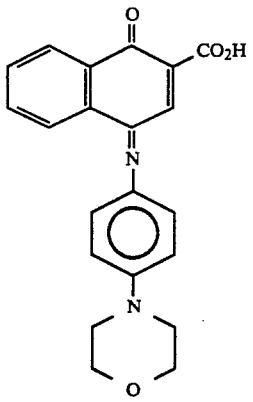

3.

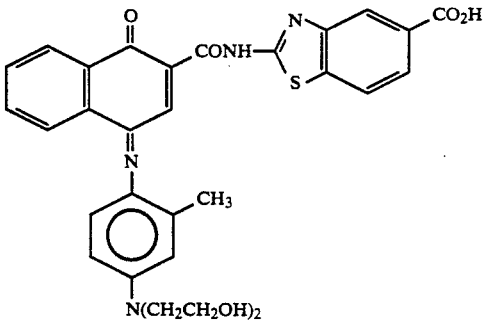

4.

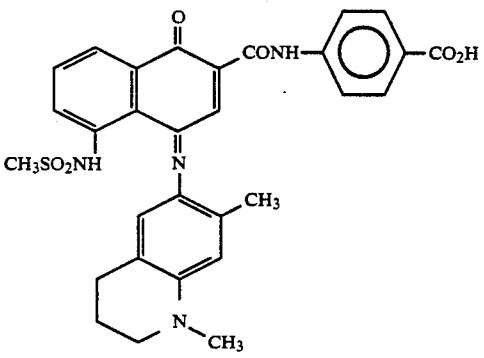

-continued
5.
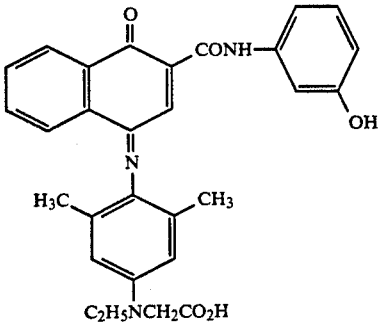
6.
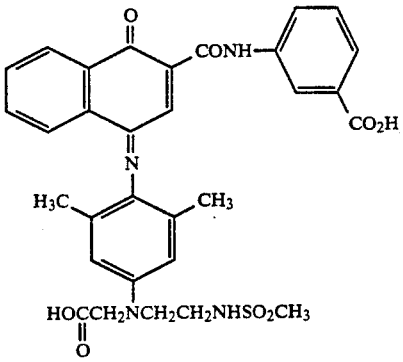
7.
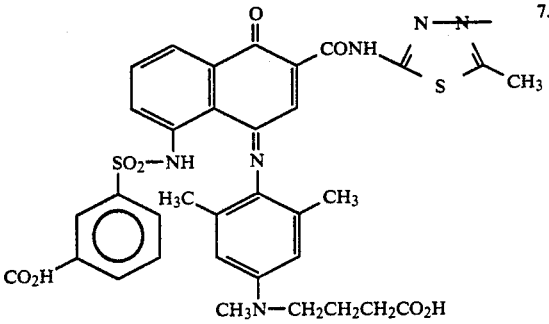
8.
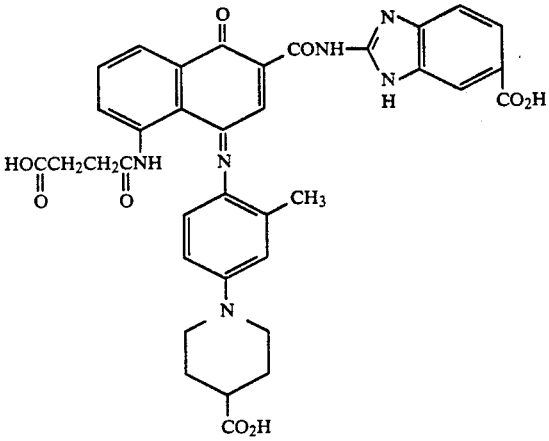
9.
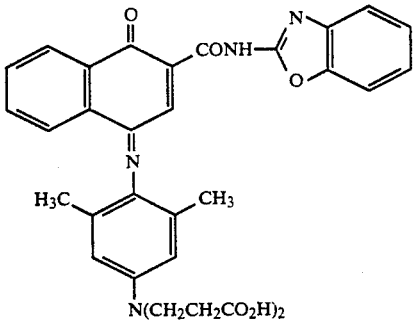
10.
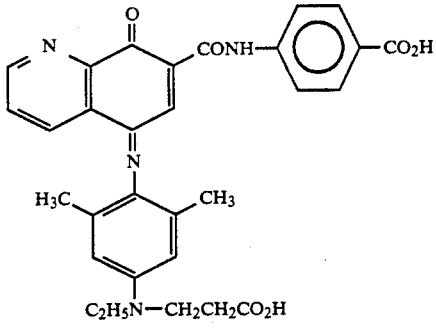
11.
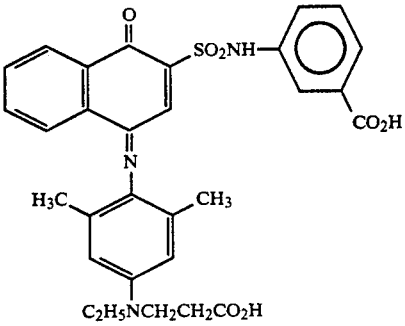
12.
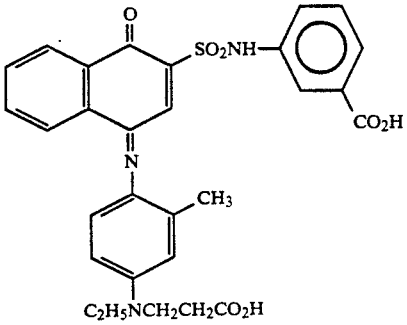

-continued
13.
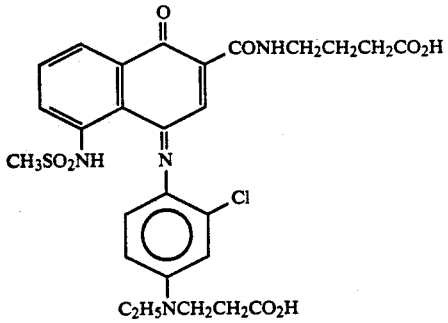
14.
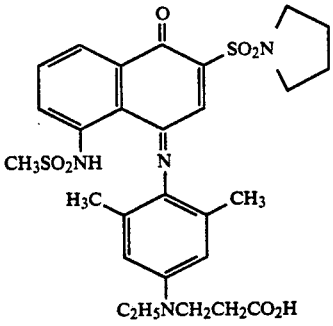
15.
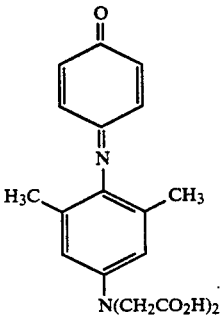
16.
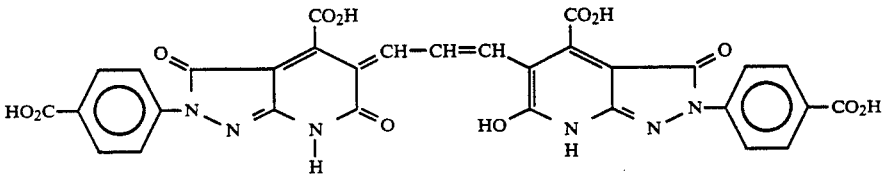
17.
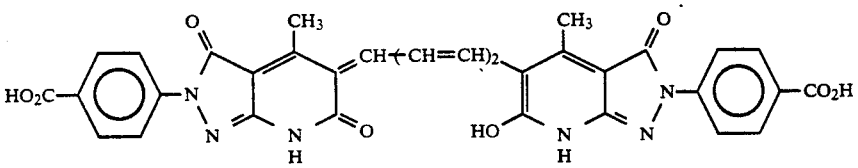
18.
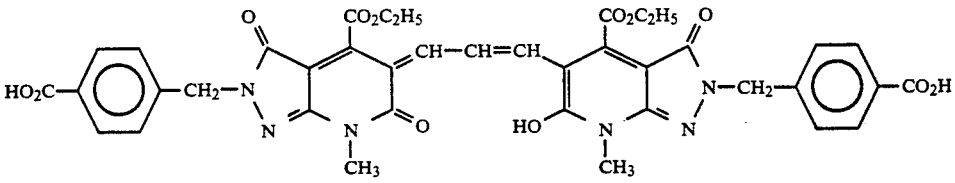
19.
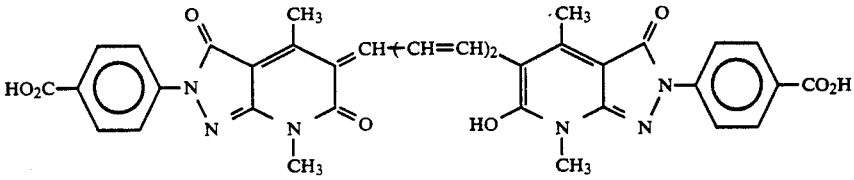
20.
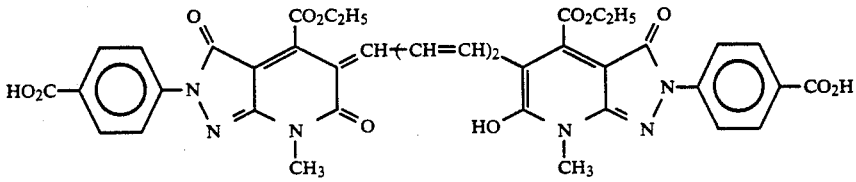

-continued
21.
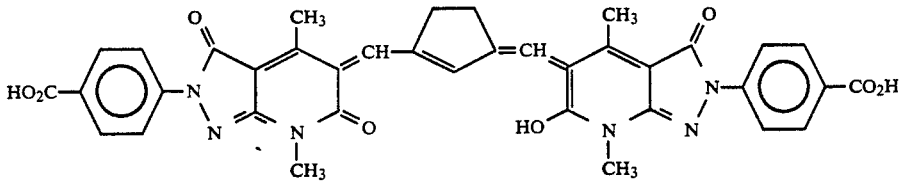
22.
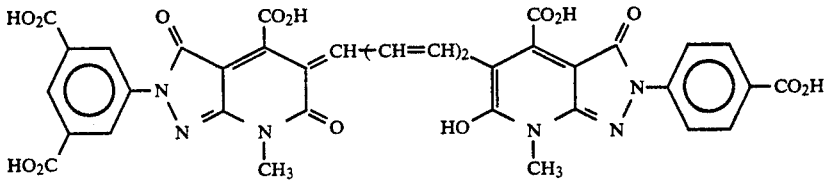
23.
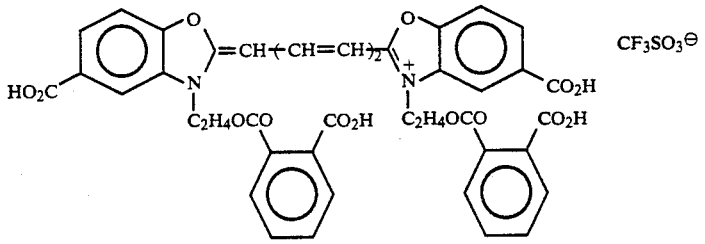
24.
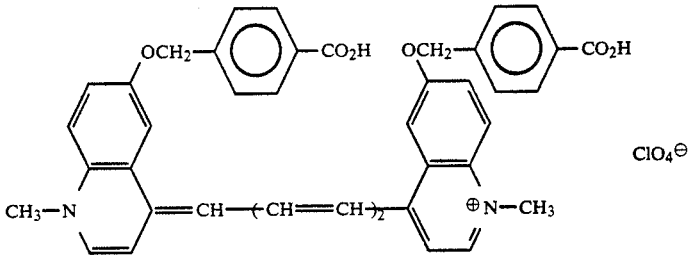
25.
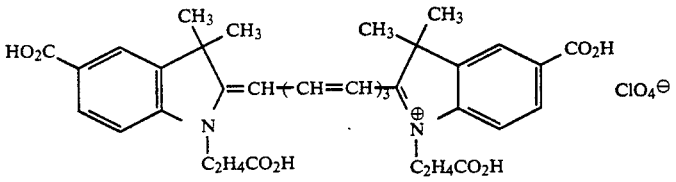
26.
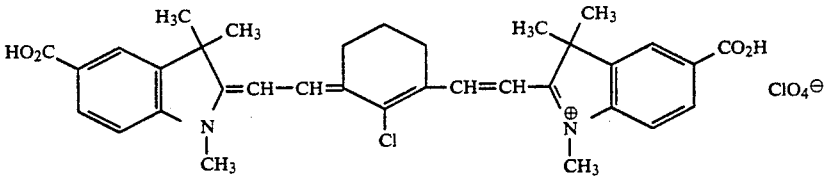
27.
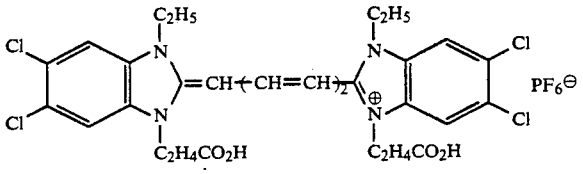

-continued
28.
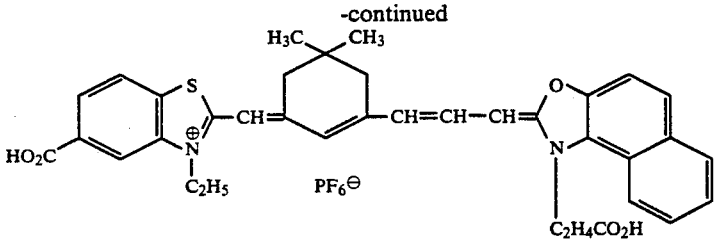
29.
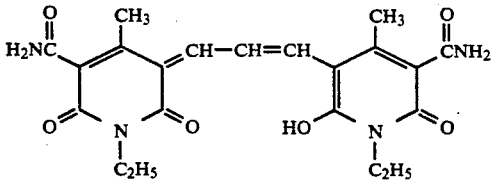
30.
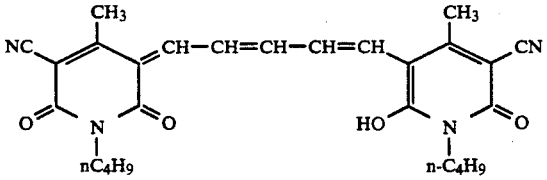
31.
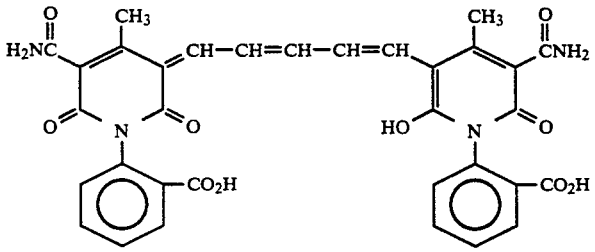
32.
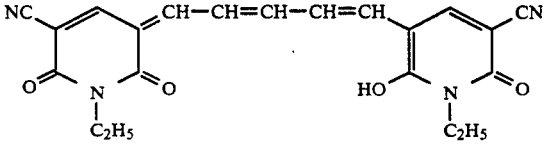
33.
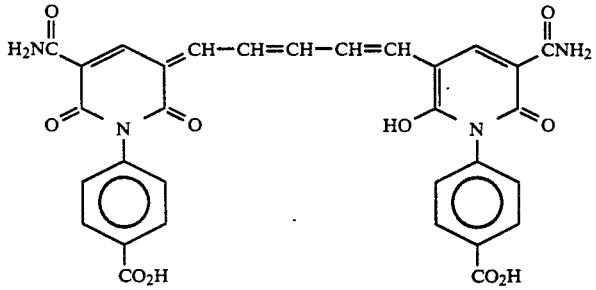
34.
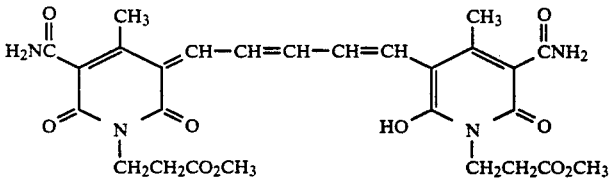
35.
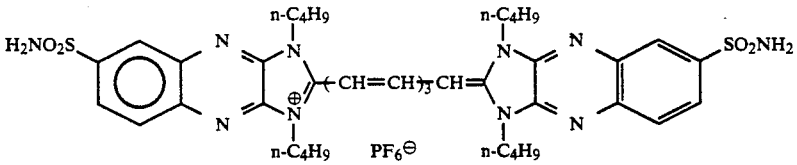
36.
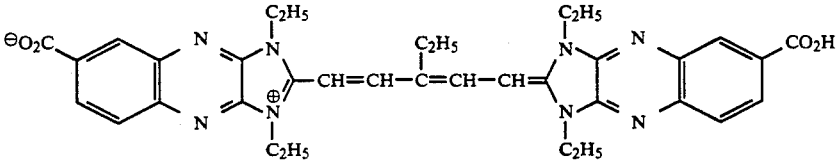

-continued
37.
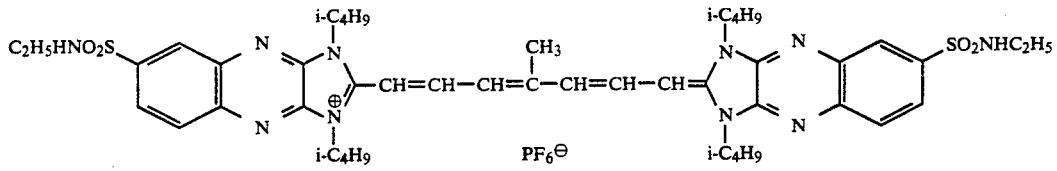
38.
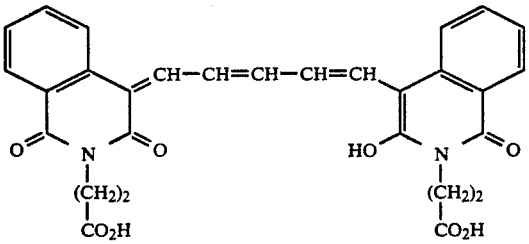
39.
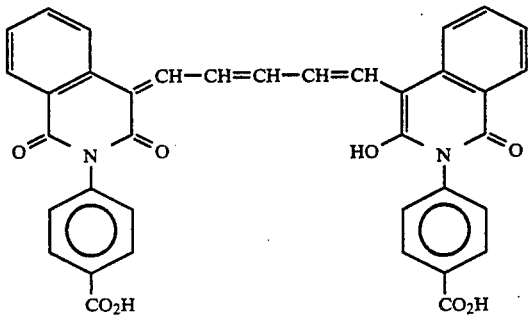
40.
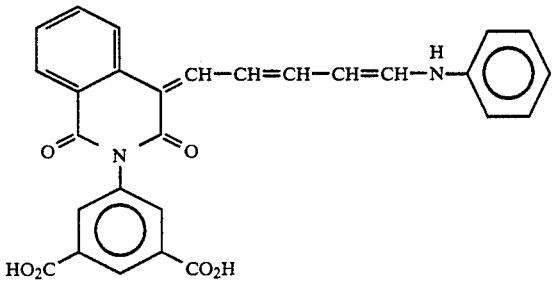
41.
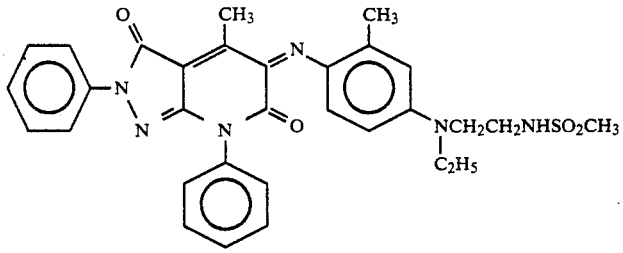
42.
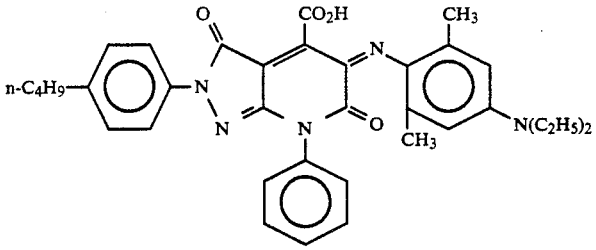
43.
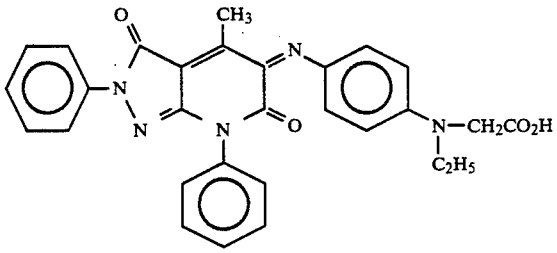

-continued
44.
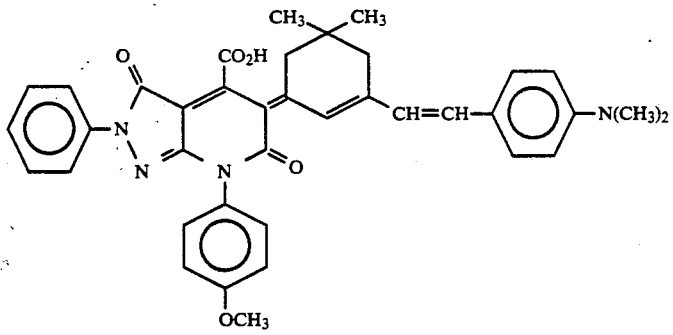
45.
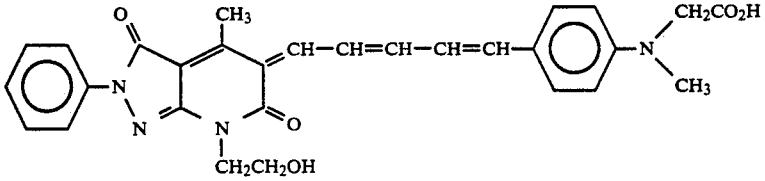
46.
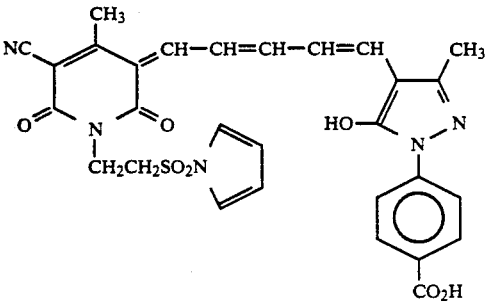
47.
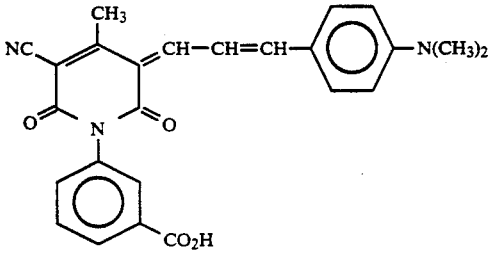
48.
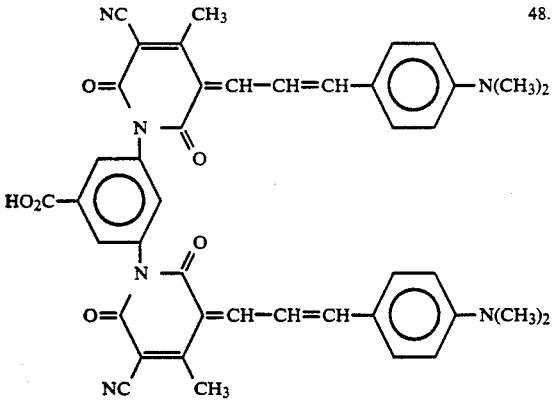
49.
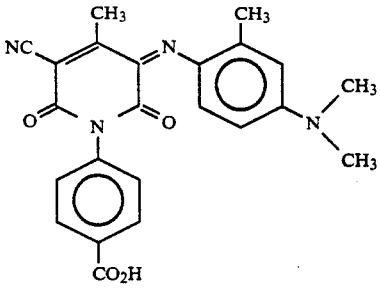
50.
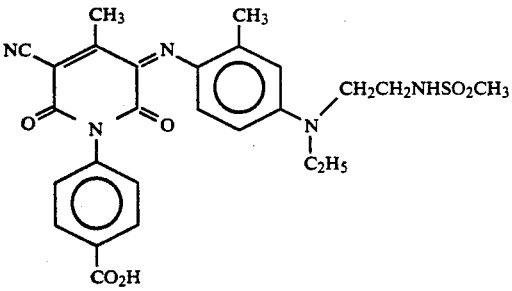
51.
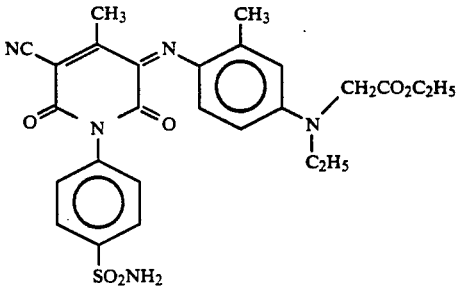

-continued

52.

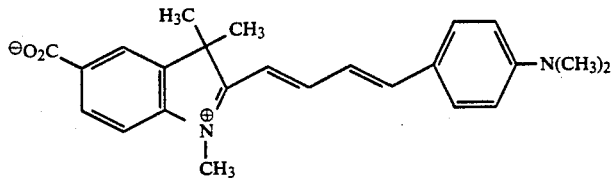

Production of these compounds may be effected with ease, for example, with reference to JP-A 2-173630, 2-230135, 2-277044, 2-282244, 3-7931, 3-13937, 3-206433, 3-208047, 3-192157, 3-216645, 3-274043, 4-37841, 4-45436, and 4-138449.

For example, a Compound 50 may be synthesized as follows:

6.8 g of 3-cyano-l-( 4'-carboxyphenyl)-6-hydroxy-4-methylpyridi-2-on and 6.3 g of 4-[N-ethyl-N-(2'-methylsulfonylaminoethyl) amino ]-2-methylnitrosobenzene were dissolved into 100 ml of methanol and the methanol solution was refluxed under heating for one hour. After cooling the solution to a room temperature, a crystal was filtered off. A crude crystal was dissolved in 50 ml of DMF and the mixture was stirred for 30 minutes with 1.0 g of an activated carbon. After filtering the activated carbon off, 180 ml of methanol was added to the filtrate, which was cooled with ice. The crystal precipitated was filtered off, followed by washing with a methanol and dried. 8.3 g of a product was obtained in 70% yield.

λmax in DMF: 660 nm; ε: $2.83\times10^4$

As other dispersions of fine solid dye grains employable in the present invention, on can use, for example, those described in JP-A 2-173630, 2-230135, 2-277044, 2-282244, 3-7931, 3-13937, 3-206443, 3-208047, 3-192157, 3-216645, 3-274043, 4-37841, 4-45436, and 4-138449.

The dispersion of fine solid dye grains for use in the present invention may be formed by any known grinding method in the presence of a dispersing agent, for example, by ball milling, shaking ball milling, planetary ball milling, sand milling, colloid milling, jet milling or roller milling optionally also in the presence of a solvent such as water or alcohol. Alternatively, the dye to be dispersed may be dissolved in a suitable solvent prior to addition of a bad solvent for the dye thereto to precipitate a fine crystalline powder of the dye, in which a surfactant for dispersion may be used. Again, the dye may be dissolved in a solvent with the pH value of the resulting solution being controlled prior to changing the pH value for precipitation of fine crystals of the dye.

The fine crystalline grains of the dye in the dispersion desirably have a mean grain size of 10 μm or less, preferably 1 μm or less, more preferably 0.5 μm or less, especially preferably, as the case may be, 0.1 μm or less.

The support of the silver halide photographic material of the present invention is not specifically defined but any support well known in this technical field may be employed.

For instance, glass, cellulose acetate film, polyethylene terephthalate film, paper, baryta-coated paper, polyolefin (e.g., polyethylene, polypropylene)-laminated paper, polystyrene film, polycarbonate film, and aluminium and other metal sheets can be used.

The support may optionally be corona-discharged by a known method or may optionally be subbed by a known method.

The constitution of the silver halide emulsion layer(s) of the silver halide photographic material of the present invention will be described below.

The silver halide photographic material of the present invention may have one or more silver halide emulsion layers.

The silver halide emulsion in the material may be produced, in general, by blending a solution of a water-soluble silver salt (e.g., silver nitrate) and a solution of water soluble halide(s) (e.g., potassium bromide) in the presence of a solution of a water-soluble polymer such as gelatin.

As the silver halide, any of silver chloride, silver bromide, silver chlorobromide, silver iodobromide and silver chloroiodobromide may be employed, and the grain shape and grain size distribution of the silver halide grains are not specifically defined.

For instance, the silver halide grains may be tabular grains having an aspect ratio of 3 or more or may also be potato-like grains or cubic or octahedral grains.

The material may have, in addition to the silver halide emulsion layer(s), other layers, such as a surface protective layer, interlayer or antihalation layer. The surface protective layer may be composed of two or more layers.

Other additives which can be used in the photographic material of the present invention and methods of processing the material are not specifically defined. For instance, one can refer to disclosures of the following references.

| | References |
|---|---|
| 1) Silver halide emulsions and methods of preparing them | JP-A 2-97937, from page 20, right bottom column, line 12 to page 21, left bottom column, line 14; JP-A 2-12236, from page 7, right top column, line 19 to page 8, left bottom column, line 12 |
| 2) Color sensitizing dyes | JP-A 2-55349, from page 7, left top column, line 8 to page 8, right bottom column, line 8 |
| 3) Surfactants, Antistatic Agents | JP-A 2-12236, page 9, from right top column, line 7 to right bottom column, line 7; JP-A 2-18542, from page 2, left bottom column, line 13 to page 4, right bottom column, line 18 |
| 4) Antifoggants, Stabilizers | JP-A 2-103536, from page 17, right bottom column, line 19 to page 18, right top column, line 4, and right bottom column, lines 1 to 5; |
| 5) Polymer latexes | JP-A 2-103536, page 18, left bottom column, lines 12 to 20 |
| 6) Acid group-containing compounds | JP-A 2-103536, from page 18, right bottom column line 6 to page 19, left top column, line 1; JP-A 2-55349, from page 8, right bottom column, line 13 to page 11, left top column, line 8 |
| 7) Polyhydroxybenzenes | JP-A 2-103536, page 11, from left top column, line 9 to right bottom column, line 17 |
| 8) Mat Agents, Lubricants, | JP-A 2-103526, page 19, from left top column, line 15 to right top column, |

-continued

| | References |
|---|---|
| Plasticizers | line 15 |
| 9) Hardening Agents | JP-A 2-103536, page 18, right top column, lines 5 to 17 |
| 10) Dyes | JP-A 2-103536, page 17, right bottom column, lines 1 to 18 |
| 11) Binders | JP-A 2-18542, page 3, right bottom column, lines 1 to 20 |
| 12) Developers and Developing Methods | JP-A 2-55349, from page 13, right bottom column, line 1 to page 16, left top column, line 10 |

The present invention may be applied to various silver halide photographic materials, such as printing photographic materials, photographic materials for micro films, X-ray photographic materials for medical use, industrial X-ray photographic materials, general negative photographic materials, general reversal photographic materials, etc.

The present invention will be explained in more detail by way of the following examples, which, however, are not intended to restrict the scope of the present invention. Unless otherwise indicated, all parts, percents, ratios and the like are by weight.

EXAMPLE 1

The following polymer layer was coated on one surface of a 180 μm-thick polyethylene terephthalate support having a subbing layer on its both sides.

| Polymer Layer: | |
|---|---|
| Latex of styrene/butadiene/divinylbenzene/methacrylic acid (20/72/6/2 by mol) | 1.5 g/m$^2$ |
| Fine grains of polymethyl methacrylate (mean grain size, 3 μm) | 10 mg/m$^2$ |
| $C_8F_{17}SO_3K$ | 5 mg/m$^2$ |

Next, the following anti-halation layer, silver halide emulsion layer and protective layer were coated in this order on the other surface of the support.

Anti-halation Layer

The solid dye as shown in Table 1 below and gelatin were blended along with $CH_2{=}CHSO_2CH_2OCH_2SO_2CH{=}CH_2$ (2.0% by weight to gelatin) as a gelatin hardening agent, and the resulting blend was coated.

For comparison, the following comparative solid dye was used.

Comparative Dye:

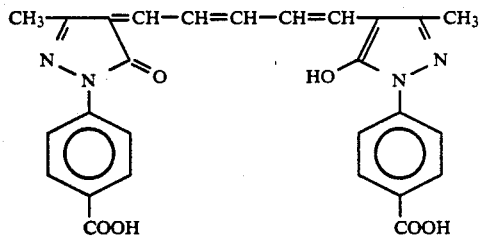

Emulsion Layer

A silver halide emulsion was prepared in the manner set forth below.

40 g of gelatin was dissolved in one liter of $H_2O$ in a container heated up to 53° C. To this were added 6 g of sodium chloride, 0.4 g of potassium bromide and 60 mg of the following compound:

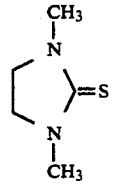

600 ml of an aqueous solution containing 100 g of silver nitrate and 600 ml of an aqueous solution containing 56 g of potassium bromide and 7 g of sodium chloride were added thereto by a double jet method to form core grains having a silver chloride content of 20 mol %. Then, 500 ml of an aqueous solution containing 100 g of silver nitrate and 500 ml of an aqueous solution containing 40 g of potassium bromide, 14 g of sodium chloride and potassium hexachloroiridate(III) (10.7 mol/mol of silver) were added thereto also by a double jet method to form shell-coated grains, the shell part having a silver chloride content of 40 mol %. Thus, monodispersed core/shell type cubic silver chlorobromide grains having a mean grain size of 0.35 μm were prepared.

After the emulsion was desired, 40 g of gelatin was added thereto. The emulsion was adjusted to have pH of 6.0 and pAg of 8.5, and 2 mg of triethylthiourea, 4 mg of chloroauric acid and 0.2 g of 4-hydroxy-6-methyl-1,3,3a,7-tetrazaindene were added thereto for effecting chemical sensitization at 60° C. The emulsion was called emulsion A.

Using emulsion A, an emulsion coating liquid was prepared by adding various additives thereto in the manner set forth below, and this emulsion coating liquid was coated on the support.

| Formulation of Emulsion Coating Liguid A: | |
|---|---|
| (a) Emulsion A | 850 g |
| (b) Color Sensitizing Dye (II) | $1.2 \times 10^{-4}$ mol |
| (c) Supersensitizing Dye (III) | $0.8 \times 10^{-3}$ mol |
| (d) Storage Stability Improving Agent (IV) | $1 \times 10^{-3}$ mol |
| (e) Polyacrylamide (molecular weight, 40,000) | 7.5 g |
| (f) Trimethylolpropane | 1.6 g |
| (g) Sodium Polystyrenesulfonate | 2.4 g |
| (h) Poly(ethyl acrylate/methacrylic acid) Latex | 16 g |
| (i) N,N'-ethylenebis-(vinylsulfonacetamide) | 1.2 g |

The coating liquid was coated on the support in an amount of 2.5 g/m$^2$ as silver.

Color Sensitizing Dye (II):

-continued

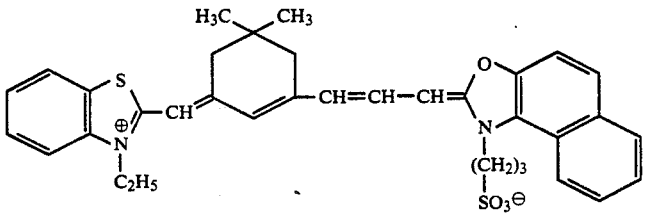

Super-color Sensitizing Dye (III):

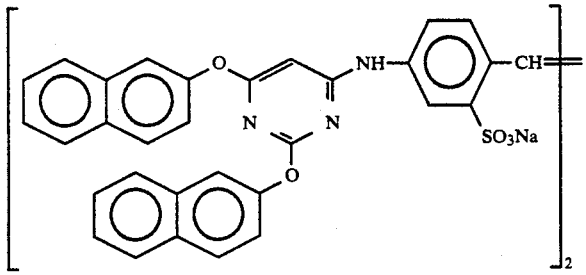

Storage Stability Improving Agent (IV):

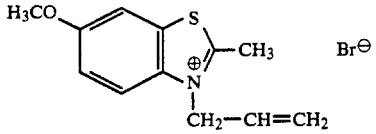

Protective Layer

The following additives were blended in a container at 40° C. to prepare a protective layer coating liquid.

| | |
|---|---|
| (a) Gelatin | 100 g |
| (b) Polyacrylamide (molecular weight, 40,000) | 10 g |
| (c) Sodium Polystyrenesulfonate (molecular weight, 600,000) | 0.6 g |
| (d) N,N'-ethylenebis-(vinylsulfonacetamide) | 1.5 g |
| (e) Fine Grains of Polymethyl Methacrylate (mean grain size, 2.0 μm) | 2.2 g |
| (f) Sodium t-octylphenoxyethoxyethanesulfonate | 1.2 g |
| (g) $C_{16}H_{33}O$-$(CH_2CH_2O)_{10}$-H | 2.7 g |
| (h) Sodium Polyacrylate | 4 g |
| (i) $C_8F_{17}SO_3K$ | 70 mg |
| (j) $C_8F_{17}SO_2N(C_3H_7)(CH_2CH_2O)_4$-$SO_3Na$ | 70 mg |
| (k) NaOH (1 N) | 4 ml |
| (l) Methanol | 60 ml |

The coating liquid was coated over the emulsion layer in an amount of 1 g/m$^2$ as gelatin.

The samples thus prepared were stored in under the condition of 25° C. and 60% RH for 10 days and then examined by the tests set forth below.

Drying Time in Automatic Developing Machine

Each sample of a quarter size (10×12 inch size) was developed in an NRN Model automatic developing machine (manufactured by Fuji Photo Film Co.) under the condition of 25° C. and 60% RH, while the line speed of the machine was varied so that the processing time was prolonged from 20 seconds by regular intervals of 5 seconds.

The dried degree of the sample just after being processed was evaluated on the basis of the level of the following three ranks. The samples as evaluated to have a dried level of "O" are acceptable ones for practical use. Table 1 below indicates the shortest processing time to It attain the level of "O".

O: Completely dried. The film was still warm.
Δ: Some wetted. The film had room temperature.
X: Not dried. The films adhered to each other.

| The processing conditions were as follows: | |
|---|---|
| Development: RD-10 (produced by Fuji Photo Film Co.) | 35° C. |
| Fixation: RF-10 (produced by Fuji Photo Film Co.) | 35° C. |
| Drying: | 55° C. |

Sharpness

Each sample was exposed by contact exposure with an MTF measuring chart. As the light source, a Xenon lamp through a band-pass filter IF-S Model (manufactured by Nippon Vacuum Optics Co.) having a maximum permeation wavelength of 750 nm was used, whereupon the quantity of the irradiating light was controlled by an ND filter.

The exposed samples were then developed with the same automatic developing machine as set forth above.

The image obtained in each sample was measured with an aperture of 2 μm×400 μm, and the MTF value of a space frequency of 20 cycles/mm was obtained for the part having an optical density of 1.0.

Color Retention

Each sample was processed with the above-mentioned automatic developing machine while the rinsing temperature after the fixation was lowered to 30° C. from 43° C., and color retention, if any, of each of the processed samples was visually evaluated by observation with the naked eye. The results as represented by the following two ranks are shown in Table 1 below.

O: Practically acceptable level.
X: Impractical level.

Film Strength

Each sample was dipped in the above-mentioned developer for 20 seconds at 35° C., and it was scratched with a 0.8 mm-diameter sapphire needle under a varying load at a speed of 60 cm/min, whereupon the load for breaking the film was obtained.

The results obtained are shown in Table 1 below.

TABLE 1

| Sample No. | Anti-halation Layer: Dye and Its Amount (mg/m²) | Anti-halation Layer: Amount of Gelatin (g/m²) | Properties: Sharpness | Properties: Drying Property (sec) | Properties: Color Retention | Properties: Film Strength |
|---|---|---|---|---|---|---|
| 1-a; comparative sample | comparative compound 120 | 1.64 | 0.72 | 80 | ○ | 190 |
| 1-b; comparative sample | 180 | 1.64 | 0.85 | 80 | X | 105 |
| 1-c; comparative sample | 240 | 1.64 | 0.89 | 80 | X | 88 |
| 1-d; comparative sample | 180 | 0.8 | 0.86 | 50 | X | 93 |
| 1-e; comparative sample | 180 | 0.5 | 0.87 | 30 | X | 71 |
| 1-f; comparative sample | 120 | 0.5 | 0.75 | 30 | ○ | 85 |
| 1-1; sample of the invention | No. 6 120 | 0.8 | 1.02 | 45 | ○ | 110 |
| 1-2; sample of the invention | No. 6 80 | 0.8 | 0.98 | 40 | ○ | 132 |
| 1-3; sample of the invention | No. 6 80 | 0.5 | 0.99 | 30 | ○ | 115 |
| 1-4; sample of the invention | No. 12 120 | 0.8 | 1.01 | 45 | ○ | 110 |
| 1-5; sample of the invention | No. 12 80 | 0.8 | 0.97 | 45 | ○ | 130 |
| 1-6; sample of the invention | No. 12 80 | 0.5 | 0.98 | 30 | ○ | 118 |
| 1-7; sample of the invention | No. 17 135 | 0.8 | 1.01 | 45 | ○ | 107 |
| 1-8; sample of the invention | No. 17 90 | 0.8 | 0.99 | 45 | ○ | 126 |
| 1-9; sample of the invention | No. 17 90 | 0.5 | 0.99 | 30 | ○ | 113 |
| 1-10; sample of the invention | No. 18 90 | 0.8 | 0.96 | 45 | ○ | 125 |
| 1-11; sample of the invention | No. 18 90 | 0.5 | 0.97 | 30 | ○ | 110 |
| 1-12; sample of the invention | No. 50 80 | 0.8 | 0.95 | 40 | ○ | 124 |
| 1-13; sample of the invention | No. 50 80 | 0.5 | 0.97 | 30 | ○ | 110 |

The comparative samples-1 each having the comparative compound could not obtain a sufficient sharpness even though the amount of the compound increased up to 240 mg/m². With elevation of the amount of the compound added, the color retention rather increased unfavorably and the film strength lowered. In view of the drying property, the comparative sample having a gelatin content of 0.8 g/m² was good, but the film strength of the sample further lowered.

As mentioned above, the comparative samples could not satisfy all the desired properties.

In contrast, the samples of the present invention had an improved sharpness, even though the amount of the dye added was small. In addition, the samples of the present invention having a gelatin content of 0.8 g/m² had a sufficient film strength of over 100 g, their drying property was good, and their color retention was small.

EXAMPLE 2

The same process as in Example 1 was repeated, except that the polymers set forth below were employed in forming the polymer layer.

Polymer A: Latex of copolymer of methyl methacrylate/acrylic acid (97/3, by mol )

Polymer B: Latex of copolymer of butyl methacrylate/methacrylic acid (97/3, by mol )

Polymer C: Latex of copolymer of ethyl acrylate/acrylic acid (97/3, by mol )

Polymer D: Latex of copolymer of styrene/butadiene/acrylic acid (30/68/2, by mol )

The combination of the polymer layer containing one of polymers A to D with the anti-halation layer of the present invention gave the result that all the photographic samples had high sharpness, high drying property, little color retention and high film strength.

EXAMPLE 3

A backing layer and a polymer layer both set forth below were coated simultaneously in this order on one surface of a 180 μm-thick polyethylene terephthalate support having a subbing layer on both surfaces and dried at 50° C. for 5 minutes.

| | |
|---|---|
| (1) Formulation of Backing Layer: | |
| Gelatin | 3.0 g/m² |
| Fine Grains of Polymethyl Methacrylate (mean grain size, 3 μm) | 50 mg/m² |
| Sodium Dodecylbenzenesulfonate | 10 mg/m² |
| Sodium Polystyrenesulfonate | 20 mg/m² |
| N,N'-ethylenebis-(vinylsulfonamide) | 30 mg/m² |
| Ethyl Acrylate Latex (mean grain size, 0.1 μm) | 1.0 g/m² |
| (2) Formulation of Polymer Layer: | |
| Latex of Copolymer of Styrene/Butadiene/Acrylic Acid (30/68/2, by mol) | 1.0 g/m² |
| Fine Grains of Silica (mean grain size, 3 μm) | 50 mg/m² |
| $C_8F_{17}SO_3K$ | 5 mg/m² |
| Sodium Dodecylbenzenesulfonate | 25 mg/m² |
| Melamine type Crosslinking Agent, Beckamin PM-N (produced by Dai-Nippon Ink & Chemicals Co.) | 1.5 mg/m² |

The same anti-halation layer, photographic emulsion layer and protective layer as in Example 1 were coated on the other surface of the support, except that the dye in the anti-halation layer and the amount of gelatin in the same layer were changed as shown in Table 2 below.

The sharpness, drying property, color retention and film strength of each sample were evaluated in the same manner as in Example 1. In addition, the curling property of each sample was evaluated in the manner set forth below.

Evaluation of Curling Property

Each sample was cut to a size of 5 cm length and 1 cm width and stored under the condition of 25° C. and 60% RH for 3 days and then under the condition of 25° C. and 10% RH for 2 hours, whereupon the degree of curling of each sample was measured. The curl value was obtained from the following equation.

$$\text{Curl Value} = 1/(\text{radius of curvature of sample, cm})$$

Where the sample curled toward the emulsion layer, the curl value has a positive number; where the sample curled away from the emulsion layer, the curl value has a negative number. The practically acceptable range of the curl value is from −0.02 to +0.02. The results obtained are shown in Table 2 below.

From Table 2, it is noted that the comparative sample having a curl value falling within the practically acceptable range was unsatisfactory with respect to the sharpness, film strength and color retention.

In contrast, the samples of the present invention satisfied all the desired properties.

TABLE 2

| Sample No. | Anti-halation Layer: Dye and Its Amount (mg/m²) | | Anti-halation Layer: Amount of Gelatin (g/m²) | Properties: Curl Value | Sharpness | Drying Property (sec) | Color Retention | Film Strength |
|---|---|---|---|---|---|---|---|---|
| 2-a; comparative sample | comparative compound | 120 | 1.64 | 0.06 | 0.72 | 80 | ○ | 190 |
| 2-b; comparative sample | | 180 | 1.64 | 0.06 | 0.85 | 80 | X | 105 |
| 2-c; comparative sample | | 180 | 1.2 | 0.04 | 0.86 | 60 | X | 98 |
| 2-d; comparative sample | | 180 | 0.8 | 0.02 | 0.86 | 50 | X | 93 |
| 2-1; sample of the invention | No. 6 | 120 | 0.8 | 0.01 | 1.02 | 45 | X | 110 |
| 2-2; sample of the invention | No. 6 | 80 | 0.8 | 0.00 | 0.98 | 40 | ○ | 132 |
| 2-3; sample of the invention | No. 6 | 80 | 0.5 | −0.01 | 0.99 | 30 | ○ | 115 |
| 2-4; sample of the invention | No. 12 | 120 | 0.8 | 0.01 | 1.01 | 40 | ○ | 110 |
| 2-5; sample of the invention | No. 12 | 80 | 0.8 | 0.00 | 0.97 | 40 | ○ | 135 |
| 2-6; sample of the invention | No. 12 | 80 | 0.5 | −0.01 | 0.98 | 30 | ○ | 120 |
| 2-7; sample of the invention | No. 13 | 120 | 0.8 | 0.01 | 1.01 | 45 | ○ | 108 |
| 2-8; sample of the invention | No. 13 | 80 | 0.8 | 0.01 | 0.98 | 40 | ○ | 131 |
| 2-9; sample of the invention | No. 13 | 80 | 0.5 | −0.01 | 0.98 | 30 | ○ | 119 |
| 2-10; sample of the invention | No. 20 | 90 | 0.8 | 0.01 | 0.99 | 40 | ○ | 123 |
| 2-11; sample of the invention | No. 20 | 90 | 0.5 | 0.00 | 0.99 | 30 | ○ | 113 |
| 2-12; sample of the invention | No. 21 | 90 | 0.8 | 0.01 | 0.97 | 40 | ○ | 127 |
| 2-13; sample of the invention | No. 21 | 90 | 0.5 | 0.00 | 0.98 | 30 | ○ | 116 |
| 2-14; sample of the invention | No. 49 | 80 | 0.8 | 0.01 | 0.97 | 40 | ○ | 125 |
| 2-15; sample of the invention | No. 49 | 80 | 0.5 | 0.00 | 0.97 | 30 | ○ | 114 |

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having a front surface and a back surface, having on the back surface a hydrophobic polymer layer which is not substantially swollen with processing solutions and a non-light-sensitive hydrophilic polymer layer between the hydrophobic polymer layer and the support and having on the front surface a hydrophilic colloid layer which contains a dispersion of fine solid grains of a dye having an absorption peak wavelength of from 600 nm to 1200 nm and which has thereon at least one light-sensitive silver halide emulsion layer.

2. A silver halide photographic element as claimed in claim 1, wherein the dye has an adsorption peak wavelength of from 630 nm to 1000 nm.

3. A silver halide photographic element as claimed in claim 1, wherein the dye is a compound represented by one of formulae (I) to (IX):

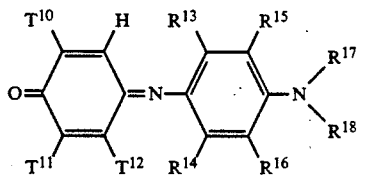

(I)

wherein $T^{10}$, $T^{11}$ and $T^{12}$ each independently represet a hydrogen atom, a halogen atom, a cyano group, a carboxyl group, an alkyl group, an aryl group, an alkoxy group, an aryloxy group, an alkylthio group, an arylthio group, an alkylsulfonyl group, an arylsulfonyl group, a sulfamoyl group, a carbamoyl group, an amino group, a sulfonamido group, a carbonamido group, an ureido group, a sulfamido group, a hydroxyl group, a vinyl group or an acyl group;

$R^{13}$ and $R^{14}$ each independently represent a hydrogen atom, a halogen atom, an alkoxy group, an alkyl group, an alkenyl group, an aryloxy group or an aryl group;

$R^{15}$ and $R^{16}$ each independently represent a hydrogen atom;

$R^{17}$ and $R^{18}$ each independently represent an alkyl group, an aryl group, a vinyl group, an acyl group, or an alkyl- or aryl-sulfonyl group;

provided that any of $T^{11}$ and $T^{12}$, $R^{13}$ and $R^{15}$, $R^{14}$ and $R^{16}$, $R^{17}$ and $R^{18}$, $R^{15}$ and $R^{17}$, and $R^{16}$ and $R^{18}$ can be bonded to each other to form a ring;

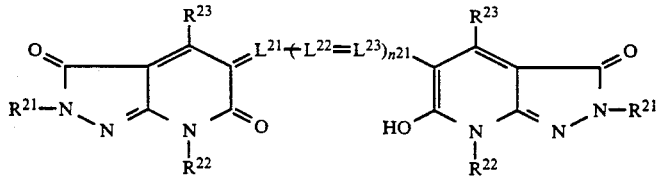

(II)

wherein $R^{21}$ represents a hydrogen atom, an alkyl group, an aryl group or a heterocyclic group;

$R^{22}$ represents a hydrogen, atom, an alkyl group, an aryl group, a heterocyclic group, $COR^{24}$ or $SO_2R^{24}$;

$R^{23}$ represents a hydrogen atom, a cyano group, a hydroxyl group, a carboxylic acid group, an alkyl group, an aryl group, $COOR^{24}$, $OR^{24}$, $NR^{25}R^{26}$, $CONR^{25}R^{26}$, $NR^{25}COR^{24}$, $NR^{25}SO_2R^{24}$ or $NR^{25}CONR^{25}R^{26}$;

$R^{24}$ represents an alkyl group or an aryl group;

$R^{25}$ and $R^{26}$ each independently represent a hydrogen atom, an alkyl group or an aryl group;

$L^{21}$, $L^{22}$ and $L^{23}$ each independently represent a methine group; and $n^{21}$ represents 1 or 2;

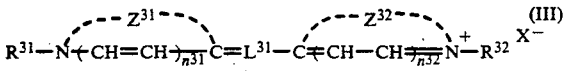

(III)

wherein $R^{31}$ and $R^{32}$ each independently represent an alkyl group, an alkenyl group or an aryl group;

$Z^{31}$ and $Z^{32}$ each independently represent a non-metallic atomic group necessary for forming a 5-membered or 6-membered nitrogen-containing hetero ring;

$L^{31}$ represents a linking .group constituted from 5 or 7 methine groups bonded to each other by conjugated double bonds;

$X^-$ represents an anion; and $n^{31}$ and $n^{32}$ each independently represent 0 or 1;

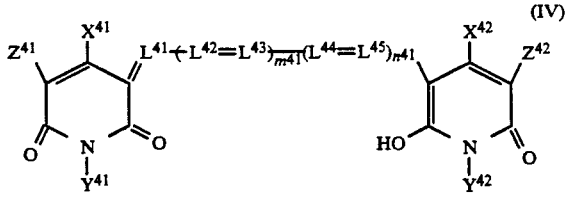

(IV)

wherein $X^{41}$ and $X^{42}$ each independently represent a hydrogen atom, a hydroxyl group, a carboxyl group, $—COOR^{41}$, $—COR^{41}$, $—CONH_2$, $—CONR^{41}R^{42}$, an alkyl group, an aryl group or a heterocyclic group;

$Y^{41}$ and $Y^{42}$ each independently represent a hydrogen atom, an alkyl group, an aryl group or a heterocyclic group;

$Z^{41}$ and $Z^{42}$ each independently represent a hydrogen atom, —CN, a carboxyl group, $—COOR^{43}$, $—COR^{43}$, $—CONH_2$, $—CONR^{43}R^{44}$, $—NHCOR^{43}$, $—NHSO_2R^{43}$, $—SO_2R^{43}$, an alkyl group, an aryl group or a heterocyclic group;

$R^{41}$ and $R^{43}$ each independently represent an alkyl group or an aryl group;

$R^{42}$ and $R^{44}$ each independently represent a hydrogen atom, an alkyl group or an aryl group;

$L^{41}$, $L^{42}$, $L^{43}$, $L^{44}$ and $L^{45}$ each independently represent a methine group; and $m^{41}$ and $n^{41}$ represent integers that add up to 2;

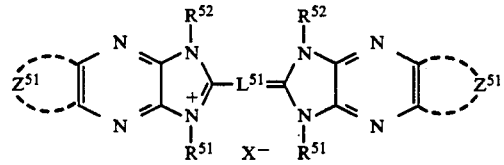

(V)

wherein $R^{51}$ and $R^{52}$ each independently represent an alkyl group, an alkenyl group or an aryl group;

$L^{51}$ represents a linking group constituted from 7 methine groups bonded to each other by conjugated double bonds;

$Z^{51}$ represents an atomic group for completing an aromatic ring in formula (V); and $X^-$ represents an anion;

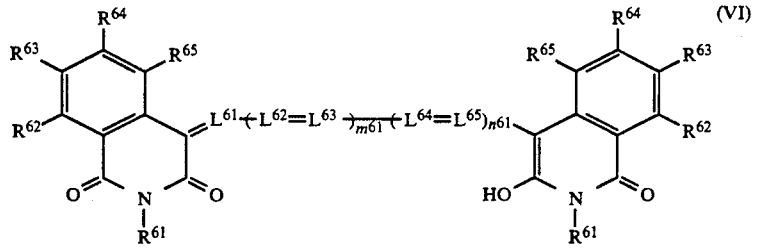

(VI)

wherein $R^{61}$ represents a hydrogen atom, an alkyl group or an aryl group;

$R^{62}$, $R^{63}$, $R^{64}$ and $^{65}$ each independently represent a hydrogen atom, an alkyl group, a halogen atom, an alkoxy group, an alkoxycarbonyl group, a carboxyl group, a hydroxyl group or an amino group;

$L^{61}$, $L^{62}$, $L^{63}$, $L^{64}$ and $L^{65}$ each independently represent a methine group; and $m^{61}$ and $n^{61}$ represent integers that add up to 2;

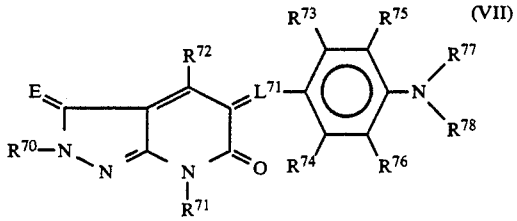

(VII)

wherein $L^{71}$ represents a nitrogen atom or a group formed by 5 or 7 substituted or unsubstituted methine groups bonded to each other by conjugated double bonds;

E represents O, S or N—$R^{79}$;

$R^{70}$ and $R^{79}$ each independently represent a hydrogen atom, an alkyl group, an alkenyl group, an alkynyl group, an aryl group, a heterocyclic group, an amino group, a hydrazino group or a diazenyl group;

$R^{71}$ represents a hydrogen, atom, an alkyl group, an aryl group, an alkenyl group, an alkynyl group, or a heterocyclic group;

$R^{72}$ represents a hydrogen atom, a halogen atom, a cyano group, a nitro group, a hydroxyl group, a carboxyl group, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an alkylsulfonyl group, an arylsulfonyl group or an alkynyl group;

$R^{70}$ and $R^{79}$ can be bonded to each other to form a ring;

$R^{73}$ and $R^{74}$ each independently represent a hydrogen atom, a halogen atom, an alkoxy group, an alkyl group, an alkenyl group, an aryloxy group or an aryl group;

$R^{75}$ and $R^{76}$ each independently represent a hydrogen atom;

$R^{77}$ and $R^{78}$ each independently represent an alkyl group, an aryl group, a vinyl group, an acyl group or an alkyl- or aryl-sulfonyl group;

provided that any of $R^{73}$ and $R^{75}$, $R^{74}$ and $R^{76}$, $R^{77}$ and $R^{78}$, $R^{75}$ and $R^{77}$, and $R^{76}$ and $R^{78}$ can be bonded to each other to form a ring;

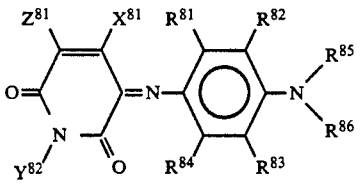

(VIII)

wherein $X^{81}$ represents a hydrogen atom, a hydroxyl group, $COOR^{87}$, $CONR^{87}R^{88}$, an alkyl group or an aryl group;

$Y^{82}$ represents a hydrogen atom, an alkyl group, an aryl group, a heterocyclic group or $NR^{87}R^{88}$;

$Z^{81}$ represents a hydrogen atom, an alkyl group, an aryl group, a cyano group, $COOR^{89}$, $CONRS^{87}R^{88}$, $COR^{89}$, $SO_2R^{89}$, $NR^{88}COR^{89}$, a nitro group or a pyridinium group;

$R^{81}$, $R^{82}$, $R^{83}$ and $R^{84}$ each independently represent a hydrogen atom, an alkyl group, $OR^{89}$, $NR^{89}COR^{87}$, $COOR^{89}$, $CONR^{87}R^{88}$ or a halogen atom;

$R^{85}$ and $R^{86}$ each independently represent a hydrogen atom, an alkyl group, an aryl group or a heterocyclic group;

$R^{87}$, $R^{88}$ and $R^{89}$ each independently represent a hydrogen atom, an alkyl group, an aryl group or a heterocyclic group;

provided that any of $R^{81}$ and $R^{82}$, $R^{85}$ and $R^{86}$, $R^{82}$ and $R^{85}$, $R^{83}$ and $R^{86}$, and $R^{87}$ and $R^{88}$ can be bonded to each other to form a 5-membered or 6-membered ring;

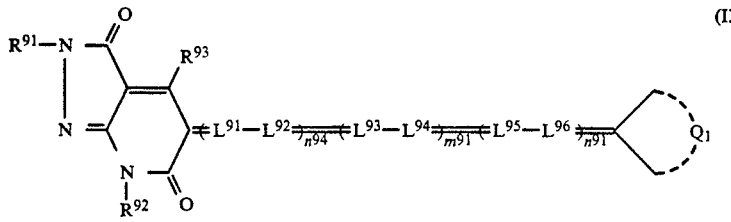

(IX)

wherein $R^{91}$, $R^{92}$ and $R^{93}$ each independently represent hydrogen atom, an alkyl group or an aryl group;

$Q^1$ represents an atomic group necessary for forming a nitrogen containing 4 to 6 membered hetero ring;

$L^{91}$, $L^{92}$, $L^{93}$, $L^{94}$, $L^{95}$ and $L^{96}$ each independently represent a methine group;

$n^{94}$, $m^{91}$ and $n^{91}$ each independently represent 0 or 1, provided that $m^{91}$, $n^{91}$ and $n^{94}$ add up to an integer of 2 or more;

provided that the compound of formula (IX) has at least one carboxyl group, a sulfonic acid arylamido group or a phenolic hydroxyl group therein.

4. A silver halide photographic element as claimed in claim 2, wherein the dye is a compound represented by one of formulae (I) to (IX):

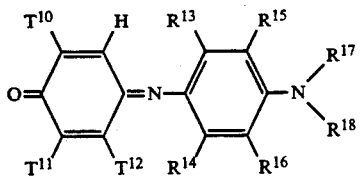

(I)

wherein $T^{10}$, $T^{11}$ and $T^{12}$ each independently represent a hydrogen atom, a halogen atom, a cyano group, a carboxyl group, an alkyl group, an aryl group, an alkoxy group, an aryloxy group, an alkylthio group, an arylthio group, an alkylsulfonyl group, an arylsulfonyl group, a sulfamoyl group, a carbamoyl group, an amino group, a sulfonamido group, a carbonamido group, an ureido group, a sulfamido group, a hydroxyl group, a vinyl group or an acyl group; $R^{13}$ and $R^{14}$ each independently represent a hydrogen atom, a halogen atom, an alkoxy group, an alkyl group, an alkenyl group, an aryloxy group or an aryl group;

$R^{15}$ and $R^{16}$ each independently represent a hydrogen atom;

$R^{17}$ and $R^{18}$ each independently represent an alkyl group, an aryl group, a vinyl group, an acyl group, or an alkyl- or aryl-sulfonyl group;

provided that any of $T^{11}$ and $T^{12}$, $R^{13}$ and $R^{15}$, $R^{14}$ and $R^{16}$, $R^{17}$ and $R^{18}$, $R^{15}$ and $R^{17}$, and $R^{16}$ and $R^{18}$ can be bonded to each other to form a ring;

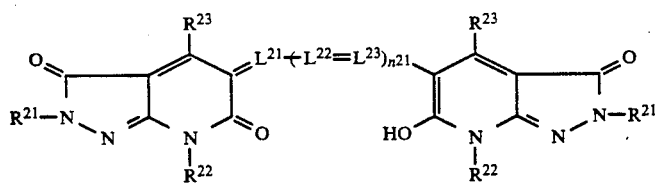

(II)

wherein $R^{21}$ represents a hydrogen atom, an alkyl group, an aryl group or a heterocyclic group;

$R^{22}$ represents a hydrogen atom, an alkyl group, an aryl group, a heterocyclic group, $COR^{24}$ or $SO_2R^{24}$;

$R^{23}$ represents a hydrogen atom, a cyano group, a hydroxyl group, a carboxylic acid group, an alkyl group, an aryl group, $COOR^{24}$, $OR^{24}$, $NR^{25}R^{26}$, $CONR^{25}R^{26}$, $NR^{25}COR^{24}$, $NR^{25}SO_2R^{24}$ or $NR^{25}CONR^{25}R^{26}$;

$R^{24}$ represents an alkyl group or an aryl group;

$R^{25}$ and $R^{26}$ each independently represent a hydrogen atom, an alkyl group or an aryl group;

$L^{21}$, $L^{22}$ and $L^{23}$ each independently represent a methine group; and $n^{21}$ represents 1 or 2;

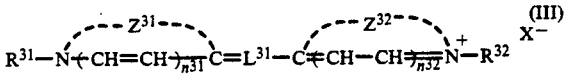

(III)

wherein $R^{31}$ and $R^{32}$ each independently represent an alkyl group, an alkenyl group or an aryl group;

$Z^{31}$ and $Z^{32}$ each independently represent a non-metallic atomic group necessary for forming a 5-membered or 6-membered nitrogen-containing hetero ring;

$L^{31}$ represents a linking group constituted from 5 or 7 methine groups bonded to each other by conjugated double bonds;

$X^{-1}$ represents an anion; and $n^{31}$ and $n^{32}$ each independently represent 0 or 1;

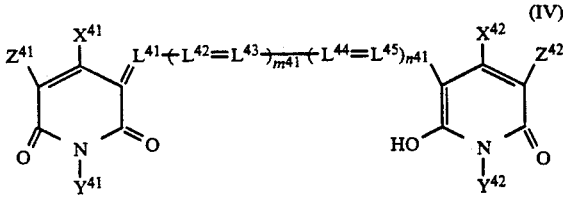

(IV)

wherein $X^{41}$ and $X^{42}$ each independently represent a hydrogen atom, a hydroxyl group, a carboxyl group, $—COOR^{41}$, $—COR^{41}$, $—CONH_2$, $—CONR^{41}R^{42}$, an alkyl group, an aryl group or a heterocyclic group;

$Y^{41}$ and $Y^{42}$ each independently represent a hydrogen atom, an alkyl group, an aryl group or a heterocyclic group;

$Z^{41}$ and $Z^{42}$ each independently represent a hydrogen atom, —CN, a carboxyl group, $—COOR^{43}$, $—COR^{43}$, $—CONH_2$, $—CONR^{43}R^{44}$, $—NHCOR^{43}$, $—NHSO_2R^{43}$, $—SO_2R^{43}$, an alkyl group, an aryl group or a heterocyclic group;

$R^{41}$ and $R^{43}$ each independently represent an alkyl group or an aryl group;

$R^{42}$ and $R^{44}$ each independently represent a hydrogen atom, an alkyl group or an aryl group;

$L^{41}$, $L^{42}$, $L^{43}$, $L^{44}$ and $L^{45}$ each independently represent a methine group; and $m^{41}$ and $n^{41}$ represent integers that add up to 2;

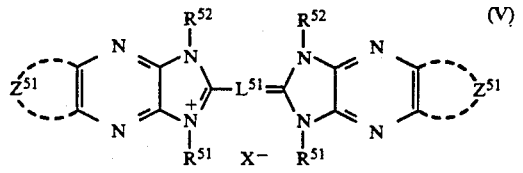

(V)

wherein $R^{51}$ and $R^{52}$ each independently represent an alkyl group, an alkenyl group or an aryl group;

$L^{51}$ represents a linking group constituted from 7 methine groups bonded to each other by conjugated double bonds;

$Z^{51}$ represents an atomic group for completing an aromatic ring in formula (V); and $X^-$ represents an anion;

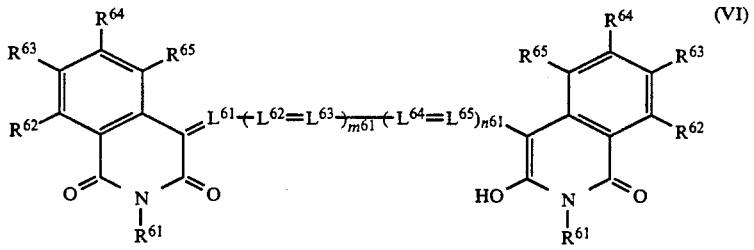

(VI)

wherein $R^{61}$ represents a hydrogen atom, an alkyl group or an aryl group;

$R^{62}$, $R^{63}$, $R^{64}$ and $^{65}$ each independently represent a hydrogen atom, an alkyl group, a halogen atom, an alkoxy group, an alkoxycarbonyl group, a carboxyl group, a hydroxyl group or an amino group;

$L^{61}$, $L^{62}$, $L^{63}$, $L^{64}$ and $L^{65}$ each independently represent a methine group; and $m^{61}$ and $n^{61}$ represent integers that add up to 2;

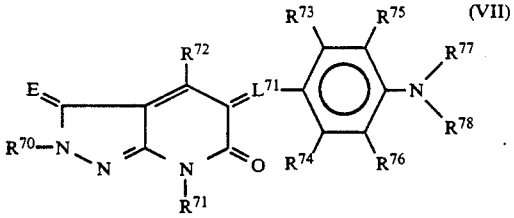

(VII)

wherein $L^{71}$ represents a nitrogen atom or a group formed by 5 or 7 substituted or unsubstituted methine groups bonded to each other by conjugated double bonds;

E represents O, S or N—$R^{79}$;

$R^{70}$ and $R^{79}$ each independently represent a hydrogen atom, an alkyl group, an alkenyl group, an alkynyl group, an aryl group, a heterocyclic group, an amino group, a hydrazino group or a diazenyl group;

$R^{71}$ represents a hydrogen atom, an alkyl group, an aryl group, an alkenyl group, an alkynyl group, or a heterocyclic group;

$R^{72}$ represents a hydrogen atom, a halogen atom, a cyano group, a nitro group, a hydroxyl group, a carboxyl group, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an alkylsulfonyl group, an arylsulfonyl group or an alkynyl group;

$R^{70}$ and $R^{79}$ can be bonded to each other to form a ring;

$R^{73}$ and $R^{74}$ each independently represent a hydrogen atom, a halogen atom, an alkoxy group, an alkyl group, an alkenyl group, an aryloxy group or an aryl group;

$R^{75}$ and $R^{76}$ each independently represent a hydrogen atom;

$R^{77}$ and $R^{78}$ each independently represent an alkyl group, an aryl group, a vinyl group, an acyl group or an alkyl- or aryl-sulfonyl group;

provided that any of $R^{73}$ and $R^{75}$, $R^{74}$ and $R^{76}$, $R^{77}$ and $R^{78}$, $R^{75}$ and $R^{77}$, and $R^{76}$ and $R^{78}$ can be bonded to each other to form a ring;

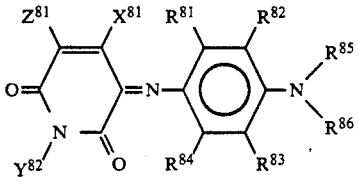

(VIII)

wherein $X^{81}$ represents a hydrogen atom, a hydroxyl group, $COOR^{87}$, $CONR^{87}R^{88}$, an alkyl group or an aryl group;

$Y^{82}$ represents a hydrogen atom, an alkyl group, an aryl group, a heterocyclic group or $NR^{87}R^{88}$;

$Z^{81}$ represents a hydrogen atom, an alkyl group, an aryl group, a cyano group, $COOR^{89}$, $CONRS^{87}R^{88}$, $COR^{89}$, $SO_2R^{89}$, $NR^{88}COR^{89}$, a nitro group or a pyridinium group;

$R^{81}$, $R^{82}$, $R^{83}$ and $R^{84}$ each independently represent a hydrogen atom, an alkyl group, $OR^{89}$, $NR^{89}COR^{87}$, $COOR^{89}$, $CONR^{87}R^{88}$ or a halogen atom;

$R^{85}$ and $R^{86}$ each independently represent a hydrogen atom, an alkyl group, an aryl group or a heterocyclic group;

$R^{87}$, $R^{88}$ and $R^{89}$ each independently represent a hydrogen atom, an alkyl group, an aryl group or a heterocyclic group;

provided that any of $R^{81}$ and $R^{82}$, $R^{85}$ and $R^{86}$, $R^{82}$ and $R^{85}$, $R^{83}$ and $R^{86}$, and $R^{87}$ and $R^{88}$ can be bonded to each other to form a 5-membered or 6-membered ring;

(IX)

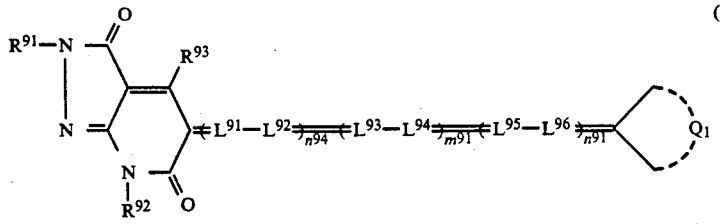

wherein $R^{91}$, $R^{92}$ and $R^{93}$ each independently represent hydrogen atom, an alkyl group or an aryl group;

$Q^1$ represents an atomic group necessary for forming a nitrogen containing 4 to 6 membered hetero ring;

$L^{91}$, $L^{92}$, $L^{93}$, $L^{94}$, $L^{95}$ and $L^{96}$ each independently represent a methine group;

$n^{94}$, $m^{91}$ and $n^{91}$ each independently represent 0 or 1, provided that $m^{91}$, $n^{91}$ and $n^{94}$ add up to an integer of 2 or more;

provided that the compound of formula (IX) has at least one carboxyl group, a sulfonic acid arylamido group or a phenolic hydroxyl group therein.

5. A silver halide photographic element as claimed in claim 1, wherein the hydrophobic polymer layer has a thickness of from 0.05 to 10 μm.

6. A silver halide photographic element as claimed in claim 1, wherein the hydrophobic polymer layer has a thickness of from 0.1 to 5 μm.

7. A silver halide photographic element as claimed in claim 1, wherein the hydrophilic polymer layer comprises lime-processed gelatin or acid-processed gelatin.

8. A silver halide photographic element as claimed in claim 2, wherein the hydrophilic polymer layer comprises lime-processed gelatin or acid-processed gelatin.

9. A silver halide photographic element as claimed in claim 3, wherein the hydrophilic polymer layer comprises lime-processed gelatin or acid-processed gelatin.

10. A silver halide photographic element as claimed in claim 4, wherein the hydrophilic polymer layer comprises lime-processed gelatin or acid-processed gelatin.

11. A silver halide photographic element as claimed in claim 7, wherein the hydrophilic polymer layer further comprises a polymer latex.

12. A silver halide photographic element as claimed in claim 8, wherein the hydrophilic polymer layer further comprises a polymer latex.

13. A Silver halide photographic element as claimed in claim 9, wherein the hydrophilic polymer layer further comprises a polymer latex.

14. A silver halide photographic element as claimed in claim 10, wherein the hydrophilic polymer layer further comprises a polymer latex.

15. A silver halide photographic element as claimed in claim 1, wherein the fine solid grains of the dye have a mean grain size of at most 1 μm.

16. A silver halide photographic element as claimed in claim 1, wherein the fine solid grains of the dye have a mean grain size of at most 0.5 μm.

* * * * *